US007930986B2

(12) United States Patent
Mizutani

(10) Patent No.: US 7,930,986 B2
(45) **Date of Patent: *Apr. 26, 2011**

(54) WATERCRAFT STEERING DEVICE AND WATERCRAFT

(75) Inventor: Makoto Mizutani, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 726 days.

This patent is subject to a terminal disclaimer.

(21) Appl. No.: 11/942,179

(22) Filed: Nov. 19, 2007

(65) Prior Publication Data

US 2008/0115711 A1 May 22, 2008

(30) Foreign Application Priority Data

Nov. 17, 2006 (JP) ..... 2006-312161

(51) Int. Cl.
*B63H 20/00* (2006.01)
*B63H 20/12* (2006.01)
*B63H 25/02* (2006.01)
*B63H 25/42* (2006.01)

(52) U.S. Cl. ..... 114/144 R; 114/144 RE; 440/1; 440/53

(58) Field of Classification Search ..... 114/144 R, 114/144 RE; 440/1, 53; 701/21
See application file for complete search history.

(56) References Cited

U.S. PATENT DOCUMENTS 2,215,003 A 9/1940 Johnson
2,224,357 A 12/1940 Pecker
3,084,657 A 4/1963 Kiekhaefer
3,233,691 A 2/1966 De Biasi
3,310,021 A 3/1967 Shimanckas
3,349,744 A 10/1967 Mercier et al.
4,120,258 A 10/1978 Spurgin
4,220,111 A 9/1980 Krautkremer et al.

(Continued)

FOREIGN PATENT DOCUMENTS

JP 62-166193 7/1987

(Continued)

OTHER PUBLICATIONS

Co-Pending U.S. Appl. No. 11/942,187, filed Nov. 19, 2007. Title: Watercraft Steering System, and Watercraft.

(Continued)

*Primary Examiner* — Ajay Vasudeva
(74) *Attorney, Agent, or Firm* — Keating & Bennett, LLP

(57) ABSTRACT

A steering wheel, operable by an operator, can be electrically connected to an electric motor to provide an actuation signal corresponding to the amount of a steering wheel operation to the electric motor, a reaction motor for applying a reaction to the steering wheel, and an ECU for controlling the electric motor are provided. The ECU can include at least one of an operation status detection device for detecting an operation status corresponding to the steering wheel operation, a running status detection device for detecting a running status of the watercraft, an outboard motor status recognition device for recognizing a status of the outboard motor, such as the installation number thereof, and an electric motor status detection device for detecting a status of the electric motor. The ECU can also include a torque computation device for making a torque target value larger depending on the detection value from the at least one device, and a reaction motor control device for controlling the reaction motor in accordance with the torque target value computed by the torque computation device.

15 Claims, 10 Drawing Sheets

U.S. PATENT DOCUMENTS

| | | | | |
|---|---|---|---|---|
| 4,373,920 | A | 2/1983 | Hall et al. | |
| 4,500,298 | A | 2/1985 | Hall et al. | |
| 4,519,335 | A | 5/1985 | Krautkremer et al. | |
| 4,637,802 | A | 1/1987 | Taguchi et al. | |
| 4,787,867 | A | 11/1988 | Takeuchi et al. | |
| 4,872,857 | A | 10/1989 | Newman et al. | |
| 4,908,766 | A | 3/1990 | Takeuchi | |
| 4,909,765 | A | 3/1990 | Riske et al. | |
| 5,029,547 | A | 7/1991 | Novey | |
| 5,031,562 | A | 7/1991 | Nakase et al. | |
| 5,231,888 | A | 8/1993 | Katahira | |
| 5,235,927 | A | 8/1993 | Singh et al. | |
| 5,244,426 | A | 9/1993 | Miyashita et al. | |
| 5,253,604 | A | 10/1993 | Bohlin | |
| 5,361,024 | A | 11/1994 | Wisner et al. | |
| 5,370,564 | A | 12/1994 | Fujimoto et al. | |
| 5,533,935 | A | 7/1996 | Kast | |
| 5,800,223 | A | 9/1998 | Iriono et al. | |
| 5,997,370 | A | 12/1999 | Fetchko et al. | |
| 6,079,513 | A | 6/2000 | Nishizaki et al. | |
| 6,230,642 | B1 | 5/2001 | McKenney et al. | |
| 6,234,853 | B1 | 5/2001 | Lanyi et al. | |
| 6,273,771 | B1 | 8/2001 | Buckley et al. | |
| 6,402,577 | B1 | 6/2002 | Treinen et al. | |
| 6,405,669 | B2 | 6/2002 | Rheault et al. | |
| 6,471,556 | B1 | 10/2002 | Yamashita et al. | |
| 6,511,354 | B1 | 1/2003 | Gonring et al. | |
| 6,535,806 | B2 | 3/2003 | Millsap et al. | |
| 6,561,860 | B2 | 5/2003 | Colyvas | |
| 6,655,490 | B2 | 12/2003 | Andonian et al. | |
| 6,671,588 | B2 | 12/2003 | Otake et al. | |
| 6,678,596 | B2 | 1/2004 | Husain et al. | |
| 6,843,195 | B2 | 1/2005 | Watabe et al. | |
| 6,855,014 | B2 | 2/2005 | Kinoshita et al. | |
| 6,892,661 | B2 | 5/2005 | Kishi et al. | |
| 6,892,662 | B2 | 5/2005 | Watanabe et al. | |
| 6,994,046 | B2 | 2/2006 | Kaji et al. | |
| 6,997,763 | B2 | 2/2006 | Kaji | |
| 7,004,278 | B2 | 2/2006 | Sugitani et al. | |
| 7,063,030 | B2 | 6/2006 | Mizutani | |
| 7,140,315 | B2 * | 11/2006 | Okuyama | 114/144 R |
| 7,156,034 | B2 | 1/2007 | Mizutani | |
| 7,267,069 | B2 | 9/2007 | Mizutani | |
| 7,267,587 | B2 | 9/2007 | Oguma et al. | |
| 7,270,068 | B2 | 9/2007 | Mizutani | |
| 2003/0077953 | A1 | 4/2003 | Kaji | |
| 2003/0150366 | A1 | 8/2003 | Kaufmann et al. | |
| 2003/0224670 | A1 | 12/2003 | Takada et al. | |
| 2003/0224672 | A1 | 12/2003 | Takada et al. | |
| 2004/0007644 | A1 | 1/2004 | Phelps et al. | |
| 2004/0031429 | A1 | 2/2004 | Kaufmann et al. | |
| 2004/0121665 | A1 | 6/2004 | Mizuguchi et al. | |
| 2004/0139902 | A1 | 7/2004 | Takada et al. | |
| 2004/0139903 | A1 | 7/2004 | Watabe et al. | |
| 2005/0118894 | A1 | 6/2005 | Kawanishi | |
| 2005/0121975 | A1 | 6/2005 | Gronau et al. | |
| 2005/0170712 | A1 | 8/2005 | Okuyama | |
| 2005/0170713 | A1 | 8/2005 | Okuyama | |
| 2005/0199167 | A1 | 9/2005 | Mizutani | |
| 2005/0199168 | A1 * | 9/2005 | Mizutani | 114/144 R |
| 2005/0199169 | A1 * | 9/2005 | Mizutani | 114/144 RE |
| 2005/0282447 | A1 | 12/2005 | Okuyama | |
| 2006/0019558 | A1 | 1/2006 | Mizutani et al. | |
| 2006/0037522 | A1 | 2/2006 | Kaneko et al. | |
| 2007/0049139 | A1 | 3/2007 | Mizutani | |
| 2007/0066154 | A1 | 3/2007 | Mizutani | |
| 2007/0066156 | A1 | 3/2007 | Mizutani | |
| 2007/0066157 | A1 | 3/2007 | Yamashita et al. | |
| 2007/0093147 | A1 | 4/2007 | Mizutani | |
| 2007/0105463 | A1 | 5/2007 | Mizutani | |
| 2008/0125925 | A1 * | 5/2008 | Mizutani | 701/21 |

FOREIGN PATENT DOCUMENTS

| | | | |
|---|---|---|---|
| JP | 01-314695 | | 12/1989 |
| JP | 02-179597 | | 7/1990 |
| JP | 02-227395 | | 9/1990 |
| JP | 03-148395 | | 6/1991 |
| JP | 04-038297 | | 2/1992 |
| JP | B-HEI 6-33077 | | 5/1994 |
| JP | 2739208 | B2 | 1/1998 |
| JP | 10-226346 | | 8/1998 |
| JP | A-HEI 10-310074 | | 11/1998 |
| JP | 2959044 | B2 | 7/1999 |
| JP | 2000-313398 | | 11/2000 |
| JP | 2000-318691 | | 11/2000 |
| JP | 3232032 | | 9/2001 |
| JP | A-2002-331948 | | 11/2002 |
| JP | A-2004-155282 | | 6/2004 |
| JP | 2005-254848 | | 9/2005 |

OTHER PUBLICATIONS

Co-Pending U.S. Appl. No. 11/942,159, filed Nov. 19, 2007. Title: Watercraft Steering Device and Watercraft.

* cited by examiner (a)

(b)

(a)

(b)

(c)

WATERCRAFT STEERING DEVICE AND WATERCRAFT

PRIORITY INFORMATION

The present application is based on and claims priority under 35 U.S.C. §119 to Japanese Patent Application No. 2006-312161, filed on Nov. 17, 2006, the entire contents of which are expressly incorporated by reference herein.

BACKGROUND OF THE INVENTIONS

1. Field of the Inventions

The present inventions relate to watercraft steering systems, and more particularly, to such systems having an electric actuator which is actuated as an operator turns a steering member and reaction force devices.

2. Description of the Related Art

Japanese Patent Document JP-A-2005-254848 discloses a steering system in which an electric actuator of the steering device is actuated as an operator operates the steering wheel. The watercraft is thus steered in response to the operation amount of the steering wheel.

External forces on the watercraft are also is detected. Based on the detected external forces, a reaction torque is applied to the steering wheel. Accordingly, the operator can feel the external force on the watercraft, such as those caused by water currents for example, directly through the steering wheel, and thus can recognize the movement of the watercraft corresponding to such external force to thereby act without delay.

SUMMARY OF THE INVENTIONS

An aspect of at least one of the embodiments disclosed herein includes the realization that in such conventional watercrafts, a reaction torque is applied to the steering wheel based on an external force to the watercraft. An operator can feel the external forces caused by water currents, for example, directly through the steering wheel, and thus can recognize the movement of the watercraft corresponding to the external force, allowing the operator to respond quickly. When the watercraft is not under an external force, an operational feel of the steering wheel can be lighter. Unfortunately, in the case where a larger output (a larger deflection torque) is required for steering, for example, when the steering wheel is operated faster, the steering motor (electric actuator) becomes less responsive, resulting in a poor operation feel. In the environment of use of an outboard motor, the steering motor pivots the outboard motor about its pivot axis. As such, the lower unit of the outboard motor (i.e., the part to which the propeller is rotatably mounted and which is normally underwater during operation) is also pivoted.

With reference to FIG. 9, it should be noted that lower unit deflection torque characteristics required for lower unit deflection (required lower unit deflection force characteristics) may change from the state shown by required lower unit deflection force characteristic line A1 to the state shown by required lower unit deflection force characteristic line A2, depending on the characteristics of the watercraft, a lower unit angle, an operation speed, or the like. In such case, a required lower unit deflection force may exceed the limit of the motor, resulting in impaired responsiveness and a poorer operation feel.

Further, as shown in FIG. 10, motor characteristics depend on the surroundings such as temperature. When the temperature becomes higher for example, the motor characteristics can change from the state shown by motor characteristic line B1 (solid line in the figure) to the state shown by motor characteristic line B2 (broken line in the figure). In such cases, since the motor characteristics at higher temperatures provide lower torque, a target lower unit deflection force required may not be obtained, resulting in impaired responsiveness and a poorer operation feel.

Thus, in accordance with an embodiment, a steering system for a watercraft can comprise a watercraft propulsion unit at a stern of the watercraft, a steering device including an electric actuator configured to actuate the steering device, the steering device changing a direction in which the watercraft travels. A steering wheel, operable by an operator, can be electrically connected to the electric actuator to provide an actuation signal corresponding to the amount of a steering wheel operation to the electric actuator. A reaction actuator can be configured to apply a reaction force to the steering wheel. Control means for controlling the reaction actuator can include at least one of operation status detection means for detecting an operation status corresponding to the steering wheel operation, running status detection means for detecting a running status of the watercraft, watercraft propulsion unit status recognition means for recognizing a status of the watercraft propulsion unit, such as the installation number thereof, and electric actuator status detection means for detecting a status of the electric actuator. Torque computation means can be provided for computing a torque target value based on the detection value from the at least one of the means. Reaction actuator control means can be provided for controlling the reaction actuator in accordance with the torque target value.

In accordance with another embodiment, a steering system for a watercraft can comprise a watercraft propulsion unit at a stern of the watercraft and a steering device including an electric actuator configured to actuate the steering device, the steering device changing a direction in which the watercraft travels. A steering wheel, operable by an operator, can be electrically connected to the electric actuator to provide an actuation signal corresponding to the amount of a steering wheel operation to the electric actuator. A reaction actuator can be configured to apply a reaction force to the steering wheel. A controller can be configured to control the reaction actuator. The controller can comprise a status device comprising at least one of an operation status detection device configured to detect an operation status corresponding to the steering wheel operation, a running status detection device configured to detect a running status of the watercraft, watercraft propulsion unit status recognition device configured to recognize a status of the watercraft propulsion unit, such as the installation number thereof, and electric actuator status detection device configured to detect a status of the electric actuator. A torque computation device can be configured to compute a torque target value based on the detection value from the status device. Additionally, a reaction actuator control device can be configured to controlling the reaction actuator in accordance with the torque target value.

BRIEF DESCRIPTION OF THE DRAWINGS

These and other features, aspects, and advantages of the present inventions are described below with reference to the drawings of preferred embodiments, which embodiments are intended to illustrate and not to limit the present inventions.

DETAILED DESCRIPTION OF THE PREFERRED EMBODIMENTS

The figures illustrate a steering system for a watercraft configured in accordance with certain features, aspects, and advantages of at least one of the inventions described herein. The watercraft merely exemplifies one type of environment in which the present inventions can be used. However, the various embodiments of the steering systems disclosed herein can be used with other types of watercraft or other vehicles that benefit from improved steering control. Such applications will be apparent to those of ordinary skill in the art in view of the description herein. The present inventions are not limited to the embodiments described, which include the preferred embodiments, and the terminology used herein is not intended to limit the scope of the present inventions.

Figure 1:
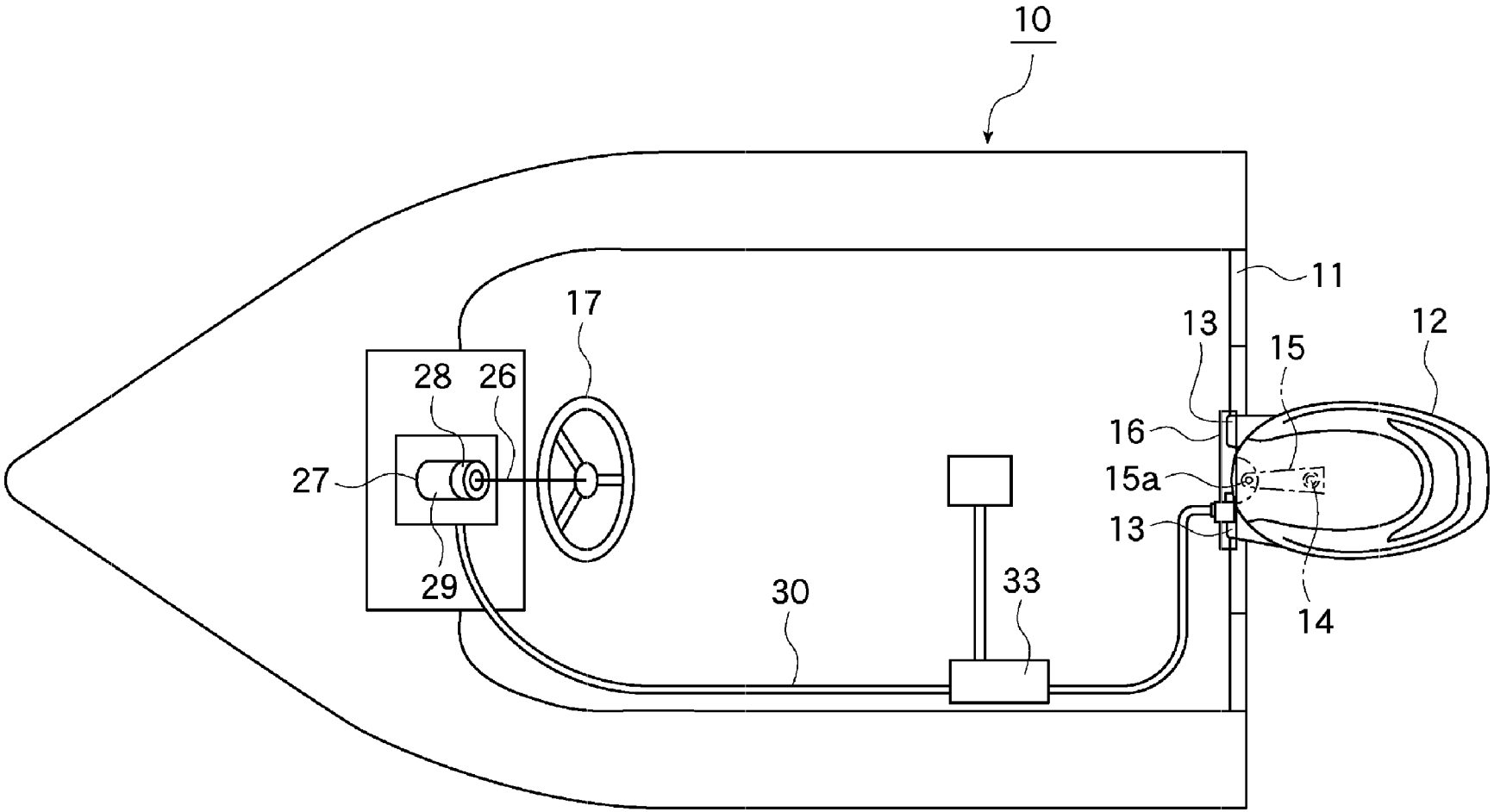
FIG. 1 is a plan view of a watercraft in accordance with an embodiment.

As shown in FIG. 1, a watercraft in accordance with this embodiment can have a hull 10 including a transom 11. To the transom 11, an outboard motor 12, which can serve as a "watercraft propulsion unit", can be mounted via clamp brackets 13. The outboard motor 12 can be pivotable about a swivel shaft (steering pivot shaft) 14 extending in a vertical direction.

A steering bracket 15 can be fixed at the upper end of the swivel shaft 14. The steering bracket 15 can be coupled at its front end 15*a* to a steering device 16. The steering device 16 can be driven by operating a steering wheel 17 disposed in an operator's section.

Figure 2:
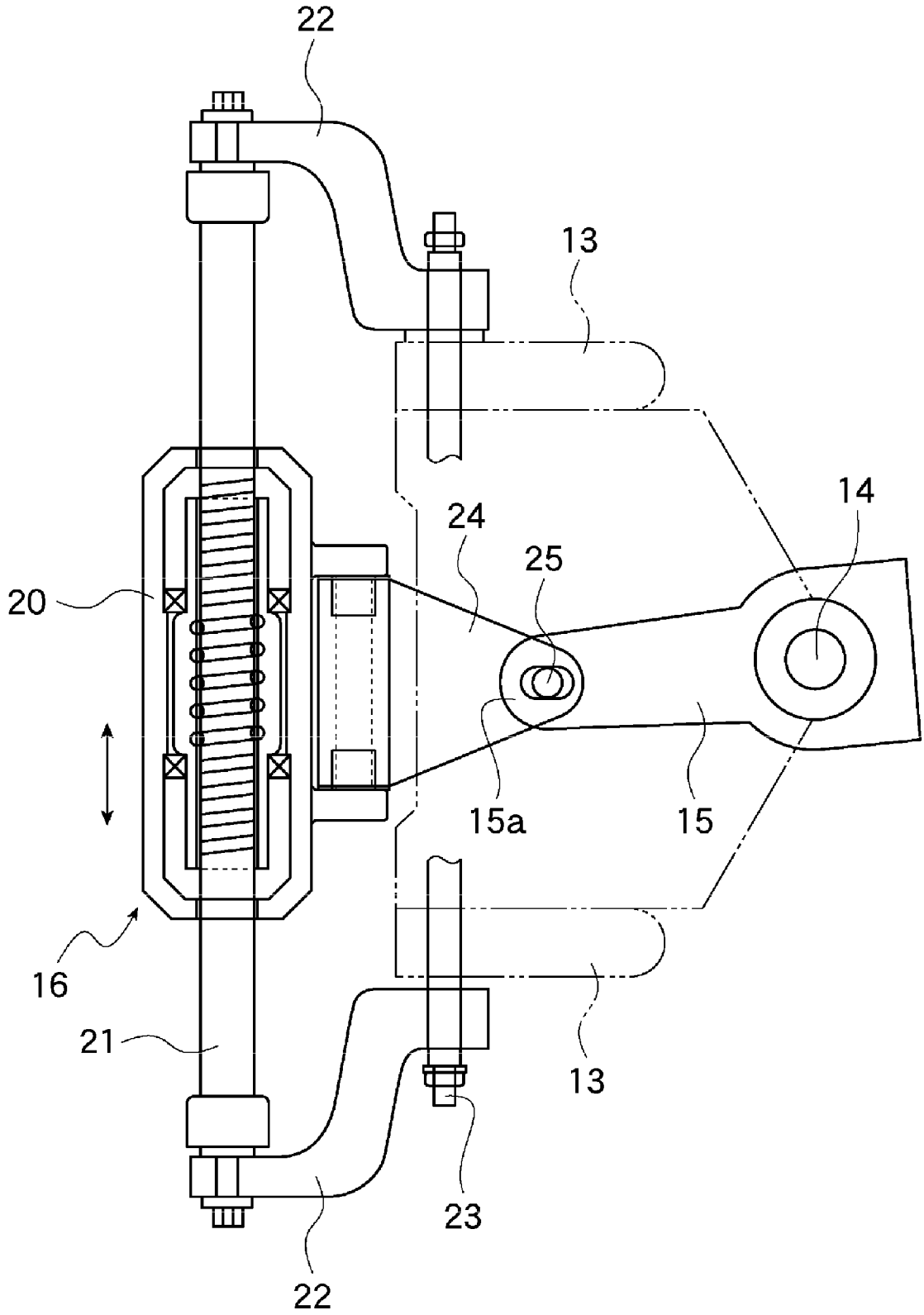
FIG. 2 is an enlarged plan view of a steering device of the watercraft in accordance with the embodiment.

As shown in FIG. 2, the steering device 16 can include a DD (direct drive) electric motor 20 for example, as an "electric actuator." The electric motor 20 can be attached to a threaded rod 21 extending in a width direction of the watercraft, and can be movable in the width direction of the watercraft along the threaded rod 21. However, other configurations can also be used.

The threaded rod 21 can be supported at its both ends by a pair of left and right supports 22. The supports 22 can be supported by a tilt shaft 23. The electric motor 20 can have a coupling bracket 24 extending rearwardly. The coupling bracket 24 and the steering bracket 15 can be coupled with each other via a coupling pin 25. However, other configurations can also be used.

As a result, as the electric motor 20 is actuated to move in the width or "transverse" direction of the watercraft relative to the threaded rod 21, the outboard motor 12 will pivot about the swivel shaft 14 via the coupling bracket 24 and the steering bracket 15.

On the other hand, as shown in FIG. 1, the steering wheel 17 can be fixed to a steering wheel shaft 26. At the proximal end of the steering shaft 26, there can be provided a steering wheel control unit 27. In some embodiments, the steering wheel control unit 27 can include a steering wheel operation angle sensor 28 configured to detect an operation angle of the steering wheel 17, and a reaction motor 29, which can serve as an "electric actuator", and which can be configured to apply a desired reaction force to the steering wheel 17 during an operation of the steering wheel 17 by the operator.

The steering wheel control unit 27 can be connected to an electronic control unit (ECU) 33, which can serve as a "control means", via a signal cable 30. The control unit 33 can be connected to the electric motor 20 of the steering device 16. The control unit 33 can be configured to receive a signal from the steering wheel operation angle sensor 28, control the electric motor 20, and to control the reaction motor 29.

Figure 4:
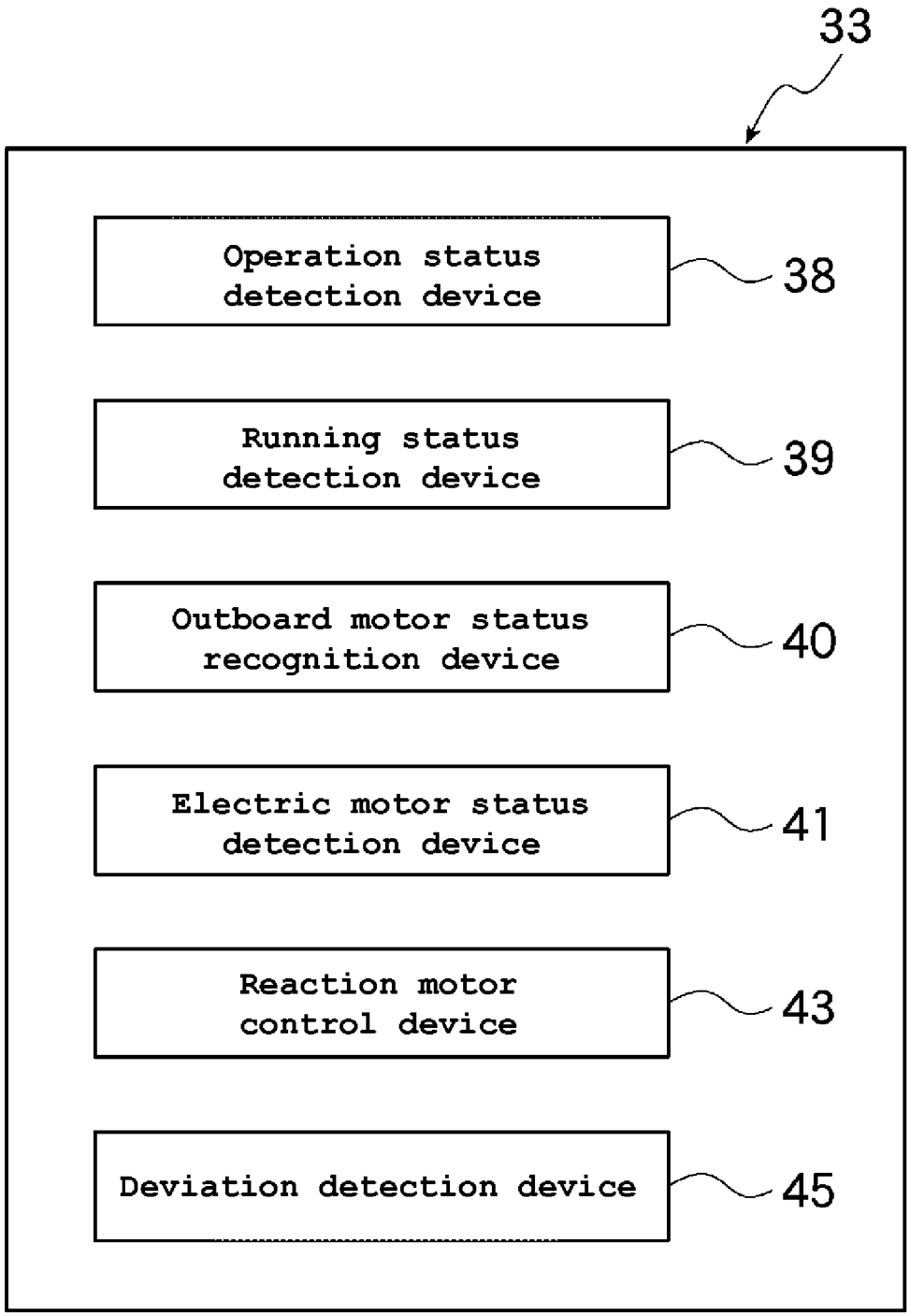
FIG. 4 is a block diagram of an ECU in accordance with an embodiment.

As shown in FIG. 4, the control unit 33 can include an operation status detection device 38 configured to detect an operation status corresponding to an operator's steering wheel operation, running status detection device 39 configured to detect a running status of the watercraft, outboard motor status recognition device 40, which can serve as a "watercraft propulsion unit status recognition means" and can be configured to recognize a status of the outboard motor 12, such as its number, and an electric motor status detection device 41, which can serve as an "electric actuator status detection means" and can be configured to detect a status of the electric motor 20. The control unit 33 can also include a torque computation device 42 configured to determine a torque target value for the reaction motor 29 larger when it determines that a load to the electric motor 20 during lower unit deflection will increase, based on the detection values from one or more of the devices 38, 39, 40, 41, etc. Additionally, the control unit 33 can also include a reaction motor control device 43 configured to control the reaction motor 29 in accordance with the torque target value computed by the torque computation device 42.

Figure 3:
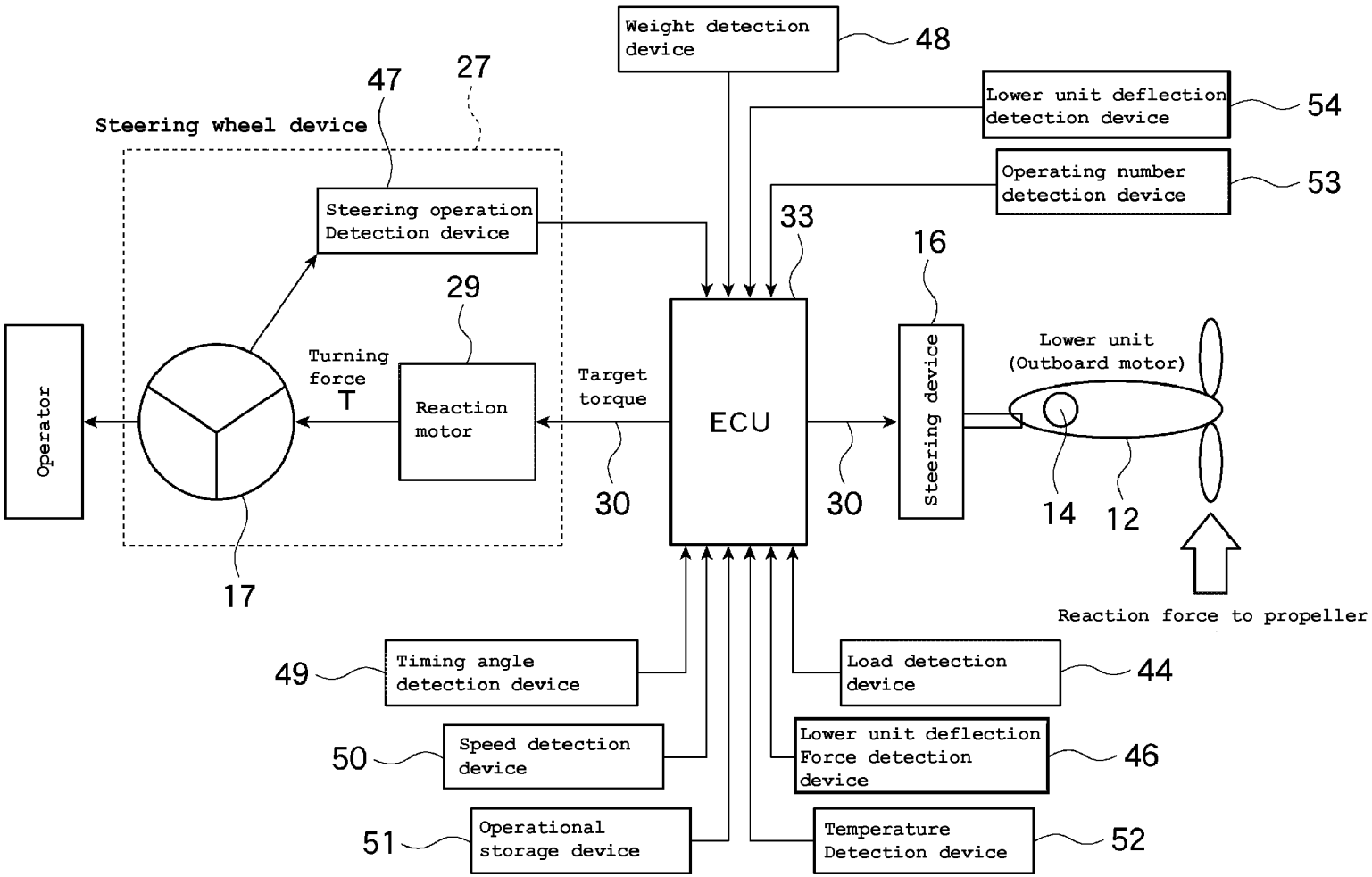
FIG. 3 is a block diagram of the watercraft in accordance with an embodiment.

As shown in FIG. 3, the operation status detection device 38 can include a torque detection device 46 for detecting a lower unit deflection force required for lower unit deflection, load detection device 44 configured to detect a load to the lower unit, such as water pressure, steering operation detection device 47 configured to detect an operation angle of the steering wheel 17, an operation speed of the steering wheel 17 and a direction in which the steering wheel can be operated, and lower unit deflection detection device 54 configured to detect a lower unit deflection angle, a lower unit deflection speed and a direction in which the lower unit can be deflected, corresponding to the operation of the steering wheel 17. The operation status detection device 38 can also includes a deviation detection device 45 configured to detect a deviation of a detected actual lower unit deflection angle from a target lower unit deflection angle corresponding to the steering wheel operation, as shown in FIG. 4. The steering wheel operation angle sensor 28 provided in the steering operation detection device 47 can be configured to detect a steering wheel operation angle.

To the running status detection device 39, there can be connected a weight detection device 48 configured to detect the position of a waterline and the weight of the watercraft, a trim angle detection device 49 configured to detect a trim angle of the watercraft, and speed detection device 50 for detecting a speed, an acceleration and a propulsive force of the watercraft, and an output of the outboard motor 12, as shown in FIG. 3.

Further, to the outboard motor status recognition device 40, there can be connected operation storage device 51 configured to store therein information on the installation number of the outboard motor 12, the installation position of the outboard motor 12 relative to the watercraft, a rotational direction of a propeller of the outboard motor 12, a propeller shape, a trim tab angle, a trim tab shape, and/or other parameters. In some embodiments, the operation storage device 51 can be included in the ECU 33.

Furthermore, the electric motor status detection device 41 can include a temperature detection device 52 configured to detect a temperature of the electric motor 20, and an operating number detection device 53 configured to detect the number of the electric motor 20 in operation, as shown in FIG. 3.

Figure 5:
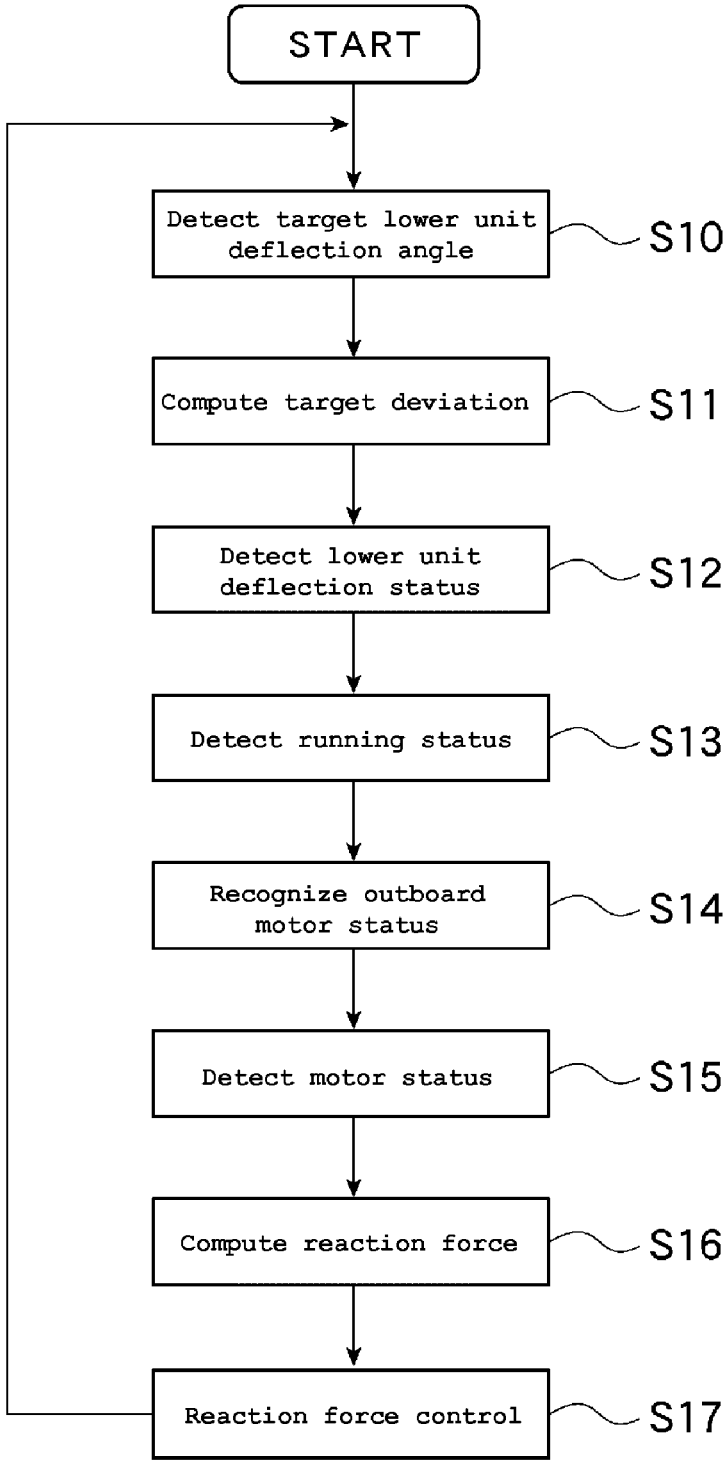
FIG. 5 is a flowchart of a reaction control process in accordance with an embodiment.

In operation, as the operator first turns the steering wheel 17 by a certain amount, a signal will be transmitted from the steering wheel operation angle sensor 28 in the steering operation detection device 47 to the ECU 33. Then, in step S10 of FIG. 5, a target lower unit deflection angle can be detected, and in step S11, a target deviation can be computed.

Further, in step S12, the operation status detection device 38 detects an operation status. As used herein, the term "operation status" can refer to a lower unit deflection torque required for deflecting the outboard motor 12, an operation angle and an operation speed of the steering wheel, a direction in which the steering wheel is operated, a deviation in lower unit deflection angle corresponding to a steering wheel operation, and/or other parameters.

The lower unit deflection torque can be detected by the torque detection device 46. The operation angle and the operation speed of the steering wheel, the direction in which the steering wheel is operated, and the like can be detected by the steering operation detection device 47. Detection signals from those devices can be transmitted to the operation status detection device 38 to thereby detect the operation status.

Further, in step S13, the running status detection device 39 detects a running status. As used herein, the term "running status" can refer to at least one of the position of a waterline, the weight, a trim angle, a speed, an acceleration and a propulsive force of the watercraft, an output of the outboard motor 12, and/or other parameters.

The position of a waterline and the weight of the watercraft can be detected by the weight detection device 48. The trim angle of the watercraft can be detected by the trim angle detection device 49. The speed, the acceleration and the propulsive force of the watercraft, and the output of the outboard motor 12 can be detected by the speed detection device 50. Detection signals from those means are transmitted to the running status detection device 39 to thereby detect the running status.

Further, in step S14, the outboard motor status recognition device 40 can recognize a status of the outboard motor 12. As used herein, the term "the status of the outboard motor 12" can refer to at least one of the installation number of the outboard motor 12, the installation position of the outboard motor 12 relative to the watercraft, a rotational direction of the propeller of the outboard motor 12, a propeller shape, a trim tab angle, a trim tab shape, and/or other parameters.

Information on the installation number of the outboard motor 12, the installation position of the outboard motor 12 relative to the watercraft, the rotational direction of the propeller of the outboard motor 12, and the like can be stored in the operation storage device 51. Such information can be read and then transmitted to the outboard motor status recognition device 40 to thereby recognize the status of the outboard motor 12.

Thereafter, in step S15, the electric motor status detection device 41 can detect a status of the electric motor 20. As used herein, the term "the status of the electric motor 20" can refer to at least one of a temperature and a voltage of the electric motor 20, the number of the electric motor 20 in operation, and/or other parameters.

The temperature of the electric motor 20 can be detected by the temperature detection device 52. A detection signal from the device 52 can be transmitted to the electric motor status detection device 41 to thereby detect the status of the electric motor 20. The number of the electric motor 20 in operation, and the like are detected by the operating number detection device 53. A detection signal from the device 53 can be transmitted to the electric motor status detection device 41.

Based on such detection values, in step S16, the torque computation device 42 in the ECU 33 can compute a reaction force for the reaction motor 29. In step S17, a signal indicating the reaction force computed can be transmitted from the reaction motor control device 43 in the ECU 33 to the reaction motor 29. Then, reaction control by the reaction motor 29 can be performed, and the process then returns to step S10.

As a result, during the operation of the watercraft by the operator, since a certain reaction force can be applied to the steering wheel 17 depending on a running status of the watercraft, and the like, the electric motor 20 can be actuated with improved responsiveness, and thus the operator can obtain an improved feel of operation when deflecting the lower unit.

In another exemplary operation, control can be dependent on steering operation status. For example, when a lower unit deflection force required for lower unit deflection is large and thereby a load to the lower unit is large, or when the lower unit is deflected in a direction which receives a reaction force to the propeller in response to a direction in which the steering wheel 17 has been operated, or a direction in which the lower unit is expected to deflect, a reaction force from the reaction motor 29 can be increased to limit an increase in the lower unit deflection force.

In a watercraft in which a steering wheel 17 and the associated outboard motor 12 are coupled with each other by a mechanical cable, the steering wheel 17 movement becomes heavier as a lower unit deflection speed increases. Thus, in some embodiments, a reaction force from the reaction motor 29 can be increased correspondingly to simulate the feeling of the mechanically connected system noted above.

Additionally, in watercraft in the steering wheel 17 and the outboard motor 12 are coupled with each other by a cable, the steering wheel 17 movement becomes heavier when the lower unit is deflected in the direction opposite to a direction which receives a reaction force to the propeller, as shown in FIG. 3, than when the lower unit is deflected in a direction which receives a reaction force to the propeller. Thus, in some embodiments, a reaction force from the reaction motor 29 can be increased correspondingly.

In another exemplary operation, control can be dependent on position of waterline, weight and trim angle. For example, when the position of a waterline is high, the weight of the watercraft is heavy, or a trim angle is small so that the watercraft 12 is positioned generally vertically in a certain fore-and-aft range, a lower unit deflection force corresponding to a lower unit angle will increase.

Accordingly, a reaction force from the reaction motor 29 can be increased in a manner making an operation feel of the steering wheel 17 heavier to thereby prevent exceeding the limit of lower unit deflection ability.

In another exemplary operation, control can be dependent on speed, propulsive force, acceleration, deceleration and output. For example, when selectively accelerating or decelerating, the watercraft can generate a propulsive force larger than that during cruising at a certain speed, which causes a reaction force on the propeller to increase.

Accordingly, a reaction force from the reaction motor 29 can be increased in a manner making an operation feel of the steering wheel 17 heavier to thereby prevent exceeding the limit of lower unit deflection ability.

During operation of a watercraft, certain parameters affect steering loads and speeds. For example, lower unit deflection load increases as the number of the outboard motors 12 increases. A lower unit deflection load also increases as the propeller increases in size.

A lower unit deflection load also increases in one direction depending on a rotational direction of the propeller. A lower unit deflection load can increase depending on the tab trim size. A lower unit deflection load can also increase when a tab trim angle is deviating from a reference position corresponding to a watercraft speed, a trim angle, and a waterline.

Accordingly, a reaction force from the reaction motor 29 can be increased in a manner making an operation feel of the steering wheel 17 heavier to thereby prevent exceeding the limit of lower unit deflection ability.

As to the installation position of the outboard motor 12, in a watercraft with a plurality of the outboard motors 12, when it is driven with less than all of the outboard motors 12 in operation, or when the individual outboard motors are in different trim status (when the lower parts of the individual outboard motor 12 have a different underwater depth), lower unit deflection load characteristics will not be the same between lower unit deflection to the left and lower unit deflection to the right. Accordingly, a propulsive force can be adjusted, depending on whether the outboard motor 12 generating the propulsive force is on the left or the right in the width direction of the watercraft, or the outboard motor 12 having a smaller trim angle and thereby a deeper underwater depth is on the left or the right in the width direction of the watercraft (the propulsive force can be decreased when the lower unit is returned from a deflected position to the side on which the outboard motor 12 of a deeper underwater depth is installed).

Figure 10:
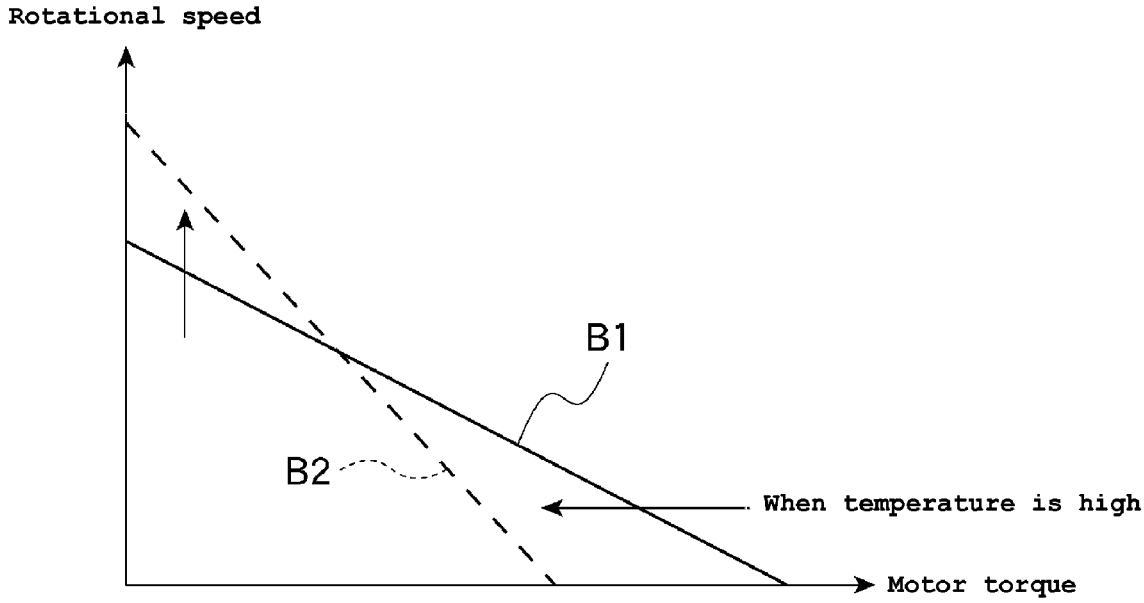
FIG. 10 is a graph of motor characteristics, illustrating the relationship between torques generated by an electric motor and rotational speeds.

Additionally, as motor temperature rises, the motor characteristic changes, as shown by broken line in FIG. 10, and thus less torque will be output from the motor. Accordingly, a reaction force from the reaction motor 29 can be increased to thereby prevent exceeding the limit of the ability of the electric motor 20.

Also, the number of the electric motors 20 in operation can be detected, and for fewer motors in operation, a reaction force from the motor 29 can be increased. More specifically, as the number of the motors operating is fewer, a reaction force from the motor 29 can be increased to thereby prevent exceeding the limit of the ability of the electric motor 20, e.g., in the case of a plurality of the electric motors 20 in use, if any of them is not operable due to a failure or the like; or in the case where a watercraft can be equipped with a plurality of the outboard motors 12 operatively coupled to each other for the same lower unit deflecting movement, each outboard motor 12 having the electric motor 20, when part of the outboard motors 12 are inactivated and the associated electric motor 20 can be also inactivated, so that the lower unit deflection can be performed using the rest of the electric motors 20.

As such, in the above watercrafts, the outboard motor 12 can be deflected by the electric motor 20. Thus, it is advantageous that an operational feel of the steering wheel 17 can be lighter; however, in the case where larger torque is required for lower unit deflection for example, when the operator operates the steering wheel 17 faster, output from the electric motor 20 may become less responsive, resulting in a poorer operation feel of the lower unit deflecting operation. Thus, in some embodiments, however, in accordance with the motor characteristics of the electric motor 20, output from the reaction motor 29 can be controlled to make an operation feel of the steering wheel 17 heavier to thereby prevent exceeding the limit of the motor characteristics of the electric motor.

Accordingly, the operational speed of the steering wheel becomes slower, and the outboard motor 12 can be deflected within the limit of the output of the electric motor 20. Thus, a poorer operation feel during the lower unit deflecting operation can be avoided.

Figure 6:
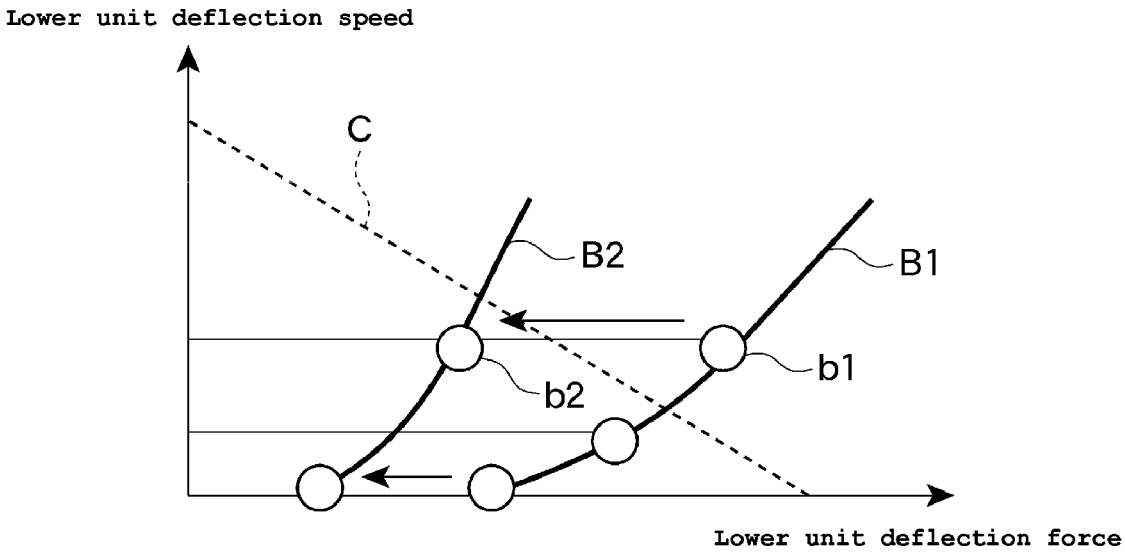
FIGS. 6(*a*) and 6(*b*) are graphs of exemplary relationships regarding reaction control states and a lower unit deflection status in accordance with an embodiment.
Figure 6:
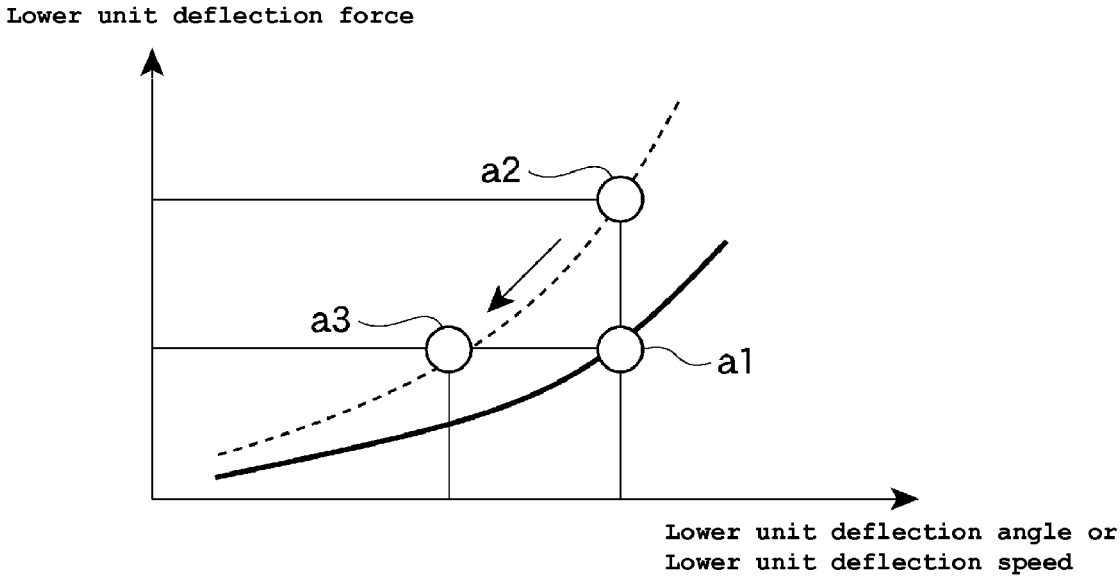

For example, as shown in FIG. 6(*b*), as a running status or an electric motor status, e.g., a watercraft speed, a trim angle, the weight, an acceleration, a deceleration, or a propulsive force, increases, the relationship between lower unit deflection angles and lower unit deflection forces will change from the characteristics shown by solid line in FIG. 6(*b*) to the characteristics as shown in broken line in the figure. Accordingly, when a lower unit deflection angle or a lower unit deflection speed is the same as that in position a1 of the characteristics shown in solid line, a lower unit deflection force increases as that in position a2 of the characteristics shown in broken line. When a lower unit deflection force is the same as that in position a1 of the characteristics shown in solid line, a lower unit deflection angle or a lower unit deflection speed decreases as that in position a3 of the characteristics shown in broken line. It should be understood that a lower unit deflection angle depends on a reaction force to the rotation of the propeller, an inclination of the watercraft, a direction and a force of wind, a direction and a flow speed of a tidal current, and a direction in which the lower unit is deflected.

As a lower unit deflection force or the like increases in this way, when a reaction force from the reaction motor 29 is small, the motor characteristics may fall outside of ability characteristic line C of the electric motor 20 as position b1 shown in characteristic line B1 in FIG. 6(*a*), which illustrates the relationship between lower unit deflection forces and lower unit deflection speeds. In such a case, when a reaction force from the reaction motor 29 is increased, as noted above in accordance with the embodiments disclosed herein, thereby changing the motor characteristics as shown by characteristic line B2, a lower unit deflection force decreases as shown in position b2 while the same lower unit deflection speed as in position b1 is kept. As a result, the motor characteristics falls within the range of ability characteristic line C. Accordingly, the outboard motor 12 can be deflected within the range of output of the electric motor 20, and thus no delayed response occurs in lower unit deflecting movement.

Figure 7:
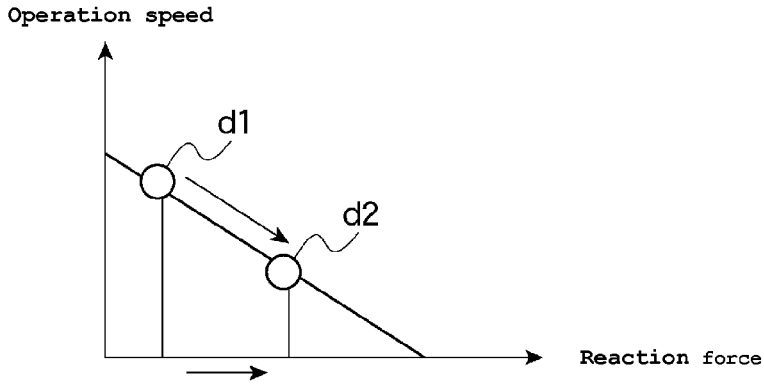
FIGS. 7(*a*), 7(*b*), and 7(*c*) are graphs of exemplary effects of reaction control in accordance with an embodiment.
Figure 7:
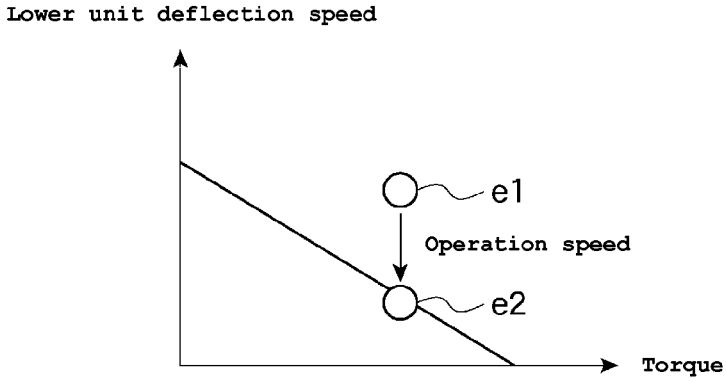
Figure 7:
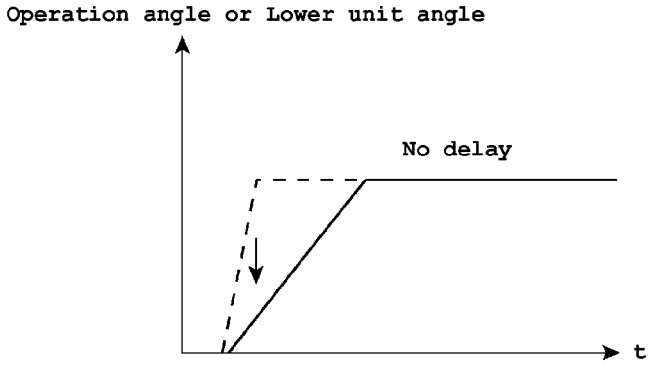

As shown in FIG. 7(*a*), as a reaction force is increased from d1 to d2, an operation speed of the steering wheel 17 will decrease from d1 to d2. Accordingly, as shown in FIG. 7(*b*), the operation speed will decrease from e1 to e2.

As a result, as shown in FIG. 7(*c*), although in the conventional, reaction uncontrolled state, an operation of the steering wheel 17 always causes a sudden change in operation angle (rudder angle) relative to time 't' as shown in broken lines in the figure, an increase in reaction force in the manner as described above provides a gradual change in the operation angle (rudder angle) relative to time 't' as shown in solid lines in the figure. This aids in preventing such sudden change.

Figure 8:
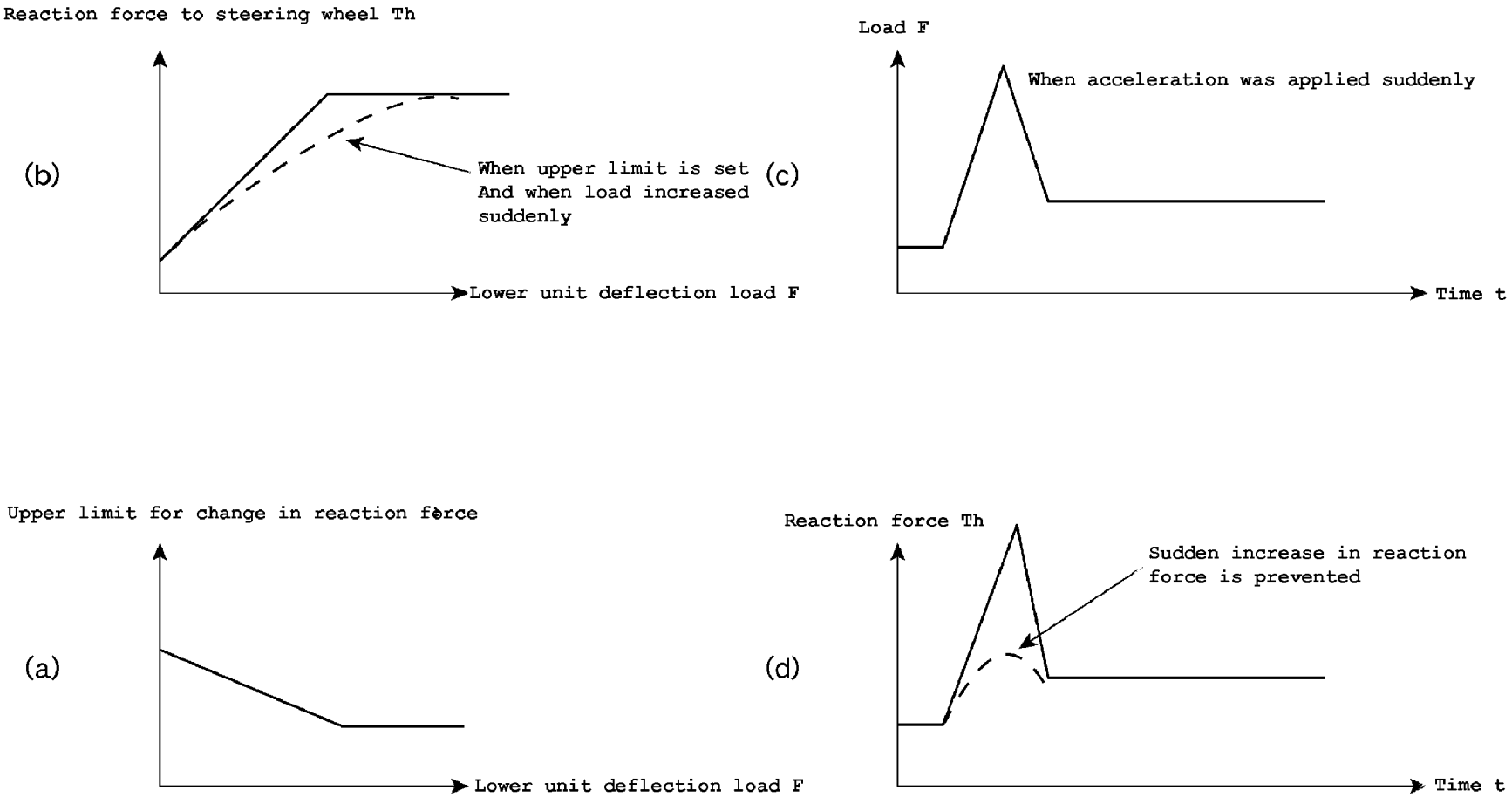
FIGS. 8(*a*), 8(*b*), 8(*c*), and 8(*d*) are graphs of exemplary reaction control states depending on a running status in accordance with an embodiment.
Figure 9:
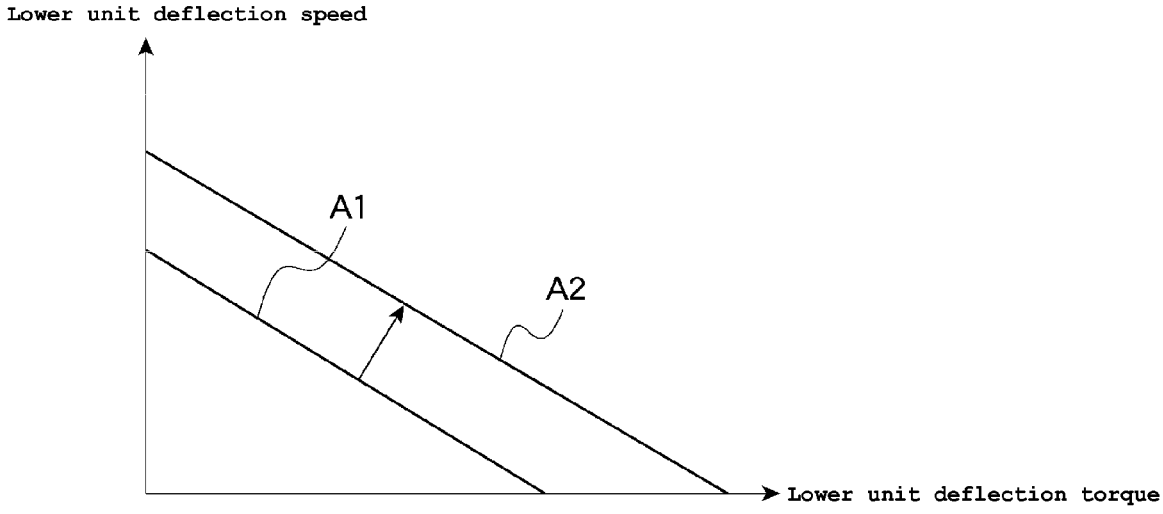
FIG. 9 is a graph of required deflection force characteristics, illustrating the relationship between lower unit deflection torques and lower unit deflection speeds.

Further, as described above, in addition to increasing a reaction force to the steering wheel and assuring responsiveness, an upper limit can be set for changes in reaction force as shown in FIG. 8(*a*), thereby providing moderate motor characteristics during a sudden increase in load as shown by broken line in FIG. 8(*b*). As a result, as shown in FIG. 8(*c*), even when there is a sudden change in load force (e.g., acceleration or deceleration, or landing on water after a jump), a sudden change in reaction force can be prevented as shown by broken line in FIG. 8(*d*).

It is a matter of course that while in the foregoing embodiments, the outboard motor 12 is used as the "watercraft propulsion unit," the present inventions are not limited to this, but may be applied to inboard-outdrive type propulsion systems. Further, some of the foregoing embodiments include the operation status detection device 38, the running status detection device 39, the outboard motor status recognition device 40 and the electric motor status detection device 41. However, in some embodiments, only at least one of those devices is provided.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A steering system for a watercraft, comprising:

a watercraft propulsion unit at a stern of the watercraft;

a steering device including an electric actuator configured to actuate the steering device, the steering device changing a direction in which the watercraft travels;

a steering wheel, operable by an operator, electrically connected to the electric actuator to provide an actuation signal corresponding to the amount of a steering wheel operation to the electric actuator;

a reaction actuator configured to apply a reaction force to the steering wheel; and control means for controlling the reaction actuator, the control means including:

at least one of operation status detection means for detecting an operation status corresponding to the steering wheel operation, running status detection means for detecting a running status of the watercraft, watercraft propulsion unit status recognition means for recognizing a status of the watercraft propulsion unit, and electric actuator status detection means for detecting a status of the electric actuator;

torque computation means for computing a torque target value based on the detection value from the at least one of the means; and reaction actuator control means for controlling the reaction actuator in accordance with the torque target value; wherein the electric actuator status detection means is connected to temperature detection means for detecting a temperature of the electric actuator.

2. The steering system for a watercraft according to claim 1, wherein the operation status detection means includes at least one of lower unit deflection force detection means for detecting a lower unit deflection force required for the lower unit deflection, load detection means for detecting a load to the lower unit, steering operation detection means for detecting a steering wheel operation angle, a steering wheel operation speed and a direction in which the steering wheel is operated, lower unit deflection detection means for detecting a lower unit deflection angle, a lower unit deflection speed and a direction in which the lower unit is deflected, corresponding to the steering wheel operation, and deviation detection means for detecting a deviation of a detected actual lower unit deflection angle from a target lower unit deflection angle corresponding to the steering wheel operation.

3. The steering system for a watercraft according to claim 2, wherein the running status detection means includes at least one of weight detection means for detecting at least one of a position of a waterline and a weight of the watercraft, trim angle detection means for detecting a trim angle of the watercraft, and speed detection means for detecting at least one of a speed, an acceleration and a propulsive force of the watercraft, and an output of the watercraft propulsion unit.

4. The steering system for a watercraft according to claim 2, wherein the watercraft propulsion unit status recognition means includes operation storage means for storing therein any one of pieces of information on the installation number of the watercraft propulsion unit, an installation position of the watercraft propulsion unit relative to the watercraft, a rotational direction of a propeller of the watercraft propulsion unit, a propeller shape, a trim tab angle and a trim tab shape.

5. The steering system for a watercraft according to claim 2, wherein the electric actuator status detection means includes operating number detection means for detecting the number of the electric actuator in operation.

6. The steering system for a watercraft according to claim 1, wherein the running status detection means includes at least one of weight detection means for detecting at least one of a position of a waterline and a weight of the watercraft, trim angle detection means for detecting a trim angle of the watercraft, and speed detection means for detecting at least one of a speed, an acceleration and a propulsive force of the watercraft, and an output of the watercraft propulsion unit.

7. The steering system for a watercraft according to claim 1, in combination with a watercraft, wherein the steering system steers the watercraft.

8. A steering system for a watercraft, comprising:

a watercraft propulsion unit at a stern of the watercraft;

a steering device including an electric actuator configured to actuate the steering device, the steering device changing a direction in which the watercraft travels;

a steering wheel, operable by an operator, electrically connected to the electric actuator to provide an actuation signal corresponding to the amount of a steering wheel operation to the electric actuator;

a reaction actuator configured to apply a reaction force to the steering wheel; and control means for controlling the reaction actuator, the control means including:

at least one of operation status detection means for detecting an operation status corresponding to the steering wheel operation, running status detection means for detecting a running status of the watercraft, watercraft propulsion unit status recognition means for recognizing a status of the watercraft propulsion unit, and electric actuator status detection means for detecting a status of the electric actuator;

torque computation means for computing a torque target value based on the detection value from the at least one of the means; and reaction actuator control means for controlling the reaction actuator in accordance with the torque target value; wherein the watercraft propulsion unit status recognition means includes operation storage means for storing therein any one of pieces of information on the installation number of the watercraft propulsion unit, an installation position of the watercraft propulsion unit relative to the watercraft, a rotational direction of a propeller of the watercraft propulsion unit, a propeller shape, a trim tab angle and a trim tab shape.

9. A steering system for a watercraft, comprising:

a watercraft propulsion unit at a stern of the watercraft;

a steering device including an electric actuator configured to actuate the steering device, the steering device changing a direction in which the watercraft travels;

a steering wheel, operable by an operator, electrically connected to the electric actuator to provide an actuation signal corresponding to the amount of a steering wheel operation to the electric actuator;

a reaction actuator configured to apply a reaction force to the steering wheel; and control means for controlling the reaction actuator, the control means including:

at least one of operation status detection means for detecting an operation status corresponding to the steering wheel operation, running status detection means for detecting a running status of the watercraft, watercraft propulsion unit status recognition means for recognizing a status of the watercraft propulsion unit, and electric actuator status detection means for detecting a status of the electric actuator;

torque computation means for computing a torque target value based on the detection value from the at least one of the means; and reaction actuator control means for controlling the reaction actuator in accordance with the torque target value; wherein the electric actuator status detection means includes operating number detection means for detecting the number of the electric actuator in operation.

10. A steering system for a watercraft, comprising:

a watercraft propulsion unit at a stern of the watercraft;

a steering device including an electric actuator configured to actuate the steering device, the steering device changing a direction in which the watercraft travels;

a steering wheel, operable by an operator, electrically connected to the electric actuator to provide an actuation signal corresponding to the amount of a steering wheel operation to the electric actuator;

a reaction actuator configured to apply a reaction force to the steering wheel; and a controller configured to control the reaction actuator, the controller comprising:

a status device comprising at least one of an operation status detection device configured to detect an operation status corresponding to the steering wheel operation, a running status detection device configured to detect a running status of the watercraft, watercraft propulsion unit status recognition device configured to recognize a status of the watercraft propulsion unit, and electric actuator status detection device configured to detect a status of the electric actuator;

a torque computation device configured to compute a torque target value based on the detection value from the status device; and a reaction actuator control device configured to controlling the reaction actuator in accordance with the torque target value; wherein the electric actuator status detection device is connected to a temperature detection device configured to detect a temperature of the electric actuator.

11. The steering system for a watercraft according to claim 10, wherein the operation status detection device includes at least one of lower unit deflection force detection device configured to detect a lower unit deflection force required for the lower unit deflection, a load detection device configured to detect a load on the lower unit, a steering operation detection device configured to detect a steering wheel operation angle, a steering wheel operation speed, and a direction in which the steering wheel is operated, a lower unit deflection detection device configured to detect a lower unit deflection angle, a lower unit deflection speed, and a direction in which the lower unit is deflected, corresponding to the steering wheel operation, and deviation detection device configured to detect a deviation of a detected actual lower unit deflection angle from a target lower unit deflection angle corresponding to the steering wheel operation.

12. The steering system for a watercraft according to claim 10, wherein the running status detection device includes at least one of weight detection device configured to detect at least one of a position of a waterline and a weight of the watercraft, trim angle detection device configured to detect a trim angle of the watercraft, and speed detection device configured to detect at least one of a speed, an acceleration and a propulsive force of the watercraft, and an output of the watercraft propulsion unit.

13. The steering system for a watercraft according to claim 10, in combination with a watercraft, wherein the steering device steers the watercraft.

14. A steering system for a watercraft, comprising:

a watercraft propulsion unit at a stern of the watercraft;

a steering device including an electric actuator configured to actuate the steering device, the steering device changing a direction in which the watercraft travels;

a steering wheel, operable by an operator, electrically connected to the electric actuator to provide an actuation signal corresponding to the amount of a steering wheel operation to the electric actuator;

a reaction actuator configured to apply a reaction force to the steering wheel; and a controller configured to control the reaction actuator, the controller comprising:

a status device comprising at least one of an operation status detection device configured to detect an operation status corresponding to the steering wheel operation, a running status detection device configured to detect a running status of the watercraft, watercraft propulsion unit status recognition device configured to recognize a status of the watercraft propulsion unit, and electric actuator status detection device configured to detect a status of the electric actuator;

a torque computation device configured to compute a torque target value based on the detection value from the status device; and a reaction actuator control device configured to controlling the reaction actuator in accordance with the torque target value; wherein the watercraft propulsion unit status recognition device includes an operation storage device configured to store therein any one of pieces of information on the installation number of the watercraft propulsion unit, an installation position of the watercraft propulsion unit relative to the watercraft, a rotational direction of a propeller of the watercraft propulsion unit, a propeller shape, a trim tab angle and a trim tab shape.

15. A steering system for a watercraft, comprising:

a watercraft propulsion unit at a stern of the watercraft;

a steering device including an electric actuator configured to actuate the steering device, the steering device changing a direction in which the watercraft travels;

a steering wheel, operable by an operator, electrically connected to the electric actuator to provide an actuation signal corresponding to the amount of a steering wheel operation to the electric actuator;

a reaction actuator configured to apply a reaction force to the steering wheel; and a controller configured to control the reaction actuator, the controller comprising:

a status device comprising at least one of an operation status detection device configured to detect an operation status corresponding to the steering wheel operation, a running status detection device configured to detect a running status of the watercraft, watercraft propulsion unit status recognition device configured to recognize a status of the watercraft propulsion unit, and electric actuator status detection device configured to detect a status of the electric actuator;

a torque computation device configured to compute a torque target value based on the detection value from the status device; and a reaction actuator control device configured to controlling the reaction actuator in accordance with the torque target value; wherein the electric actuator status detection device includes an operating number detection device configured to detect the number of the electric actuator in operation.

* * * * *